US009509059B2

(12) United States Patent
Roberts

(10) Patent No.: US 9,509,059 B2
(45) Date of Patent: Nov. 29, 2016

(54) REFLECTOR ANTENNA INCLUDING DUAL BAND SPLASHPLATE SUPPORT

(71) Applicant: ASTRIUM LIMITED, Stevenage (GB)

(72) Inventor: Richard William Roberts, Stevenage (GB)

(73) Assignee: ASTRIUM LIMITED, Hertfordshire (GB)

( * ) Notice: Subject to any disclaimer, the term of this patent is extended or adjusted under 35 U.S.C. 154(b) by 136 days.

(21) Appl. No.: 14/356,075

(22) PCT Filed: Oct. 30, 2012

(86) PCT No.: PCT/EP2012/071513
§ 371 (c)(1),
(2) Date: May 2, 2014

(87) PCT Pub. No.: WO2013/064514
PCT Pub. Date: May 10, 2013

(65) Prior Publication Data

US 2014/0292605 A1 Oct. 2, 2014

(30) Foreign Application Priority Data

Nov. 2, 2011 (EP) ..... 11275137

(51) Int. Cl.
*H01Q 13/00* (2006.01)
*H01Q 19/13* (2006.01)
(Continued)

(52) U.S. Cl.
CPC ..... *H01Q 19/134* (2013.01); *H01Q 13/20* (2013.01); *H01Q 19/193* (2013.01)

(58) Field of Classification Search
CPC ..... H01Q 19/134; H01Q 19/193
USPC ..... 343/781 P, 781 CA, 840
See application file for complete search history.

(56) References Cited

U.S. PATENT DOCUMENTS 3,983,560 A 9/1976 MacDougall
6,020,859 A * 2/2000 Kildal ..... H01Q 1/42 343/781 CA (Continued)

FOREIGN PATENT DOCUMENTS

CN 201490341 U 5/2010
CN 201540963 U 8/2010

(Continued)

OTHER PUBLICATIONS

International Search Report (PCT/ISA/210) mailed on Feb. 8, 2013, by the European Patent Office as the International Searching Authority for International Application No. PCT/EP2012/071513.

(Continued)

*Primary Examiner* — Dameon E Levi
*Assistant Examiner* — Hasan Islam
(74) *Attorney, Agent, or Firm* — Buchanan Ingersoll & Rooney PC

(57) ABSTRACT

A reflector antenna includes a dual-band waveguide feed and a splashplate support arranged to define a space between the waveguide feed aperture and the splashplate. The dual-band waveguide feed is configured to receive an input signal in a first transmission mode, to convert a transmission mode of an upper frequency band from a first transmission mode to a mixed transmission mode including the first transmission mode and a second transmission mode. The supporting portion can be spaced apart from the aperture of the waveguide feed, and may have a thickness corresponding to half a wavelength of a beam emitted from the aperture.

14 Claims, 12 Drawing Sheets

(51) Int. Cl.
*H01Q 13/20* (2006.01)
*H01Q 19/19* (2006.01)

(56) References Cited

U.S. PATENT DOCUMENTS

| | | | | |
|---|---|---|---|---|
| 6,107,973 | A * | 8/2000 | Knop | H01Q 17/001 343/781 CA |
| 6,724,349 | B1 | 4/2004 | Baird et al. | |
| 7,764,236 | B2 * | 7/2010 | Hill | H01Q 1/243 343/702 |
| 8,581,795 | B2 * | 11/2013 | Simms | H01Q 1/42 343/781 CA |
| 2008/0094298 | A1 * | 4/2008 | Kralovec | H01Q 19/19 343/781 CA |
| 2008/0238790 | A1 * | 10/2008 | McGrath | H01Q 3/14 343/754 |

FOREIGN PATENT DOCUMENTS

| | | |
|---|---|---|
| EP | 0 136 818 A1 | 4/1985 |
| GB | 2 161 324 A | 1/1986 |
| JP | 4-10413 U | 1/1992 |
| JP | H11-4116 A | 1/1999 |

OTHER PUBLICATIONS

Written Opinion (PCT/ISA/237) mailed on Feb. 8, 2013, by the European Patent Office as the International Searching Authority for International Application No. PCT/EP2012/071513.

European Search Report dated Mar. 21, 2012.

Lee, Institute of Electrical and Electronics Engineers: "A compact EHF dual-frequency antenna for ASCAMP", Military Communications in a Changing World, Nov. 4, 1991, pp. 1123-1127.

Office Action issued on Feb. 1, 2016, by the State Intellectual Property Office of the People's Republic of China in corresponding Chinese Patent Application No. 201280065499.3, and an English Translation of the Office Action. (15 pages).

Office Action issued May 24, 2016 by the Japanese Patent Office in corresponding Japanese Patent Application No. 2014-539319 with an English translation thereof (5 pages).

* cited by examiner

REFLECTOR ANTENNA INCLUDING DUAL BAND SPLASHPLATE SUPPORT

DESCRIPTION

The present invention relates to a reflector antenna including a dual-band splashplate support. In particular, the present invention relates to a reflector antenna including a dual-band waveguide feed and a splashplate support arranged to define a space between the waveguide feed aperture and a splashplate of the reflector antenna.

Reflector antennas are widely used, for example in land, airborne and naval terminals, and in communications satellites, to shape and direct a beam of electromagnetic radiation towards a particular location. A conventional reflector antenna 100 is illustrated in FIGS. 1A and 1B, and comprises a waveguide feed horn 110, a primary reflector 120, a splashplate 130 and a supporting dielectric 140 coupling the splashplate 130 to the waveguide feed 110. The feed horn 110 receives an input signal $i_0$ and directs the signal to an aperture of the feed horn 110. The signal is emitted from the aperture as a beam of electromagnetic radiation, and reflected by the splashplate 130 towards the primary reflector 120, which in turn shapes and directs the beam towards the desired location, for example a particular satellite or a geographical region on Earth. The feed horn 110, splashplate 130 and primary reflector 120 can be configured to shape the beam as required for a particular application.

As shown in FIG. 1B, the supporting dielectric 140 comprises an elongate portion 140*a* for inserting into a throat of the feed horn 110, and a conical portion 140*b* extending out from the elongate portion 140*a* towards the splashplate 130. The supporting dielectric 140 may itself be shaped internally and externally to provide the required radiation pattern and to minimise return losses. For example, the conical portion 140*b* may include various steps and grooves, and the portion inside the waveguide feed 140*a* may be stepped or profiled. However, the supporting dielectric 140 can only be specifically designed and optimised for a certain specific frequency or narrow band of frequencies. The conventional splashplate reflector antenna 100 is therefore unsuitable for use with wideband (e.g. >20% bandwidth) and/or dual-band applications, in which the beam to be shaped and directed includes a wide range of frequencies.

According to the present invention, there is provided a reflector antenna comprising a dual-band waveguide feed configured to receive an input signal in a first transmission mode, the input signal including a plurality of frequencies arranged into upper and lower frequency bands, and the waveguide feed including means for converting a transmission mode of the upper frequency band from a first transmission mode to a mixed transmission mode including the first transmission mode and a second transmission mode, a reflector, a splashplate configured to direct a beam emitted from an aperture of the waveguide feed to the reflector and a splashplate support comprising a first engaging portion for engaging with the waveguide feed, a second engaging portion for engaging with the splashplate, and a supporting portion connecting the first engaging portion to the second engaging portion, and arranged to define a space between the waveguide feed aperture and the splashplate.

The supporting portion may be configured to be spaced apart from the aperture of the waveguide feed in a direction away from the splashplate, when the first engaging portion is engaged with the waveguide feed.

The supporting portion may have a thickness less than or equal to substantially $\lambda/2$, where $\lambda$ is a characteristic wavelength of the beam inside the supporting portion.

The characteristic wavelength may be a wavelength corresponding to a centre frequency of a transmission band of the beam emitted from the aperture of the waveguide feed, or an average wavelength of the beam, or a value between the average wavelength and the wavelength corresponding to the centre frequency.

The supporting portion may have a shape corresponding to a wavefront of the beam emitted from the waveguide feed after it has been reflected from the splashplate.

The supporting portion may be curved or elliptical in cross-section.

The supporting portion may be a substantially continuous wall.

The first engaging portion may be configured to engage with an outer surface of the waveguide feed.

The splashplate support may be formed of polytetrafluoroethylene PTFE.

The means for converting the transmission mode may be spaced apart from the aperture by a predetermined distance, such that for the upper band both the first and second transmission modes are substantially in phase at the aperture.

The means for converting the transmission mode of the upper frequency band may comprise a taper, one or more steps, or a profiled change in the internal diameter of the waveguide feed, and may connect a section of a first diameter $D_1$ to a section of a second diameter $D_2$, wherein the second diameter is greater than the first diameter.

The first transmission mode may be a $TE_{11}$ mode and the second transmission mode may be a $TM_{11}$ mode.

The waveguide feed may be circular in cross-section, and a diameter of the aperture may be substantially one wavelength of a frequency in the lower frequency band.

The waveguide feed may be configured for use at Ka band frequencies.

According to the present invention, there is also provided a satellite including the reflector antenna.

Embodiments of the present invention will now be described, by way of example only, with reference to the accompanying drawings, in which.

Figure 1A:
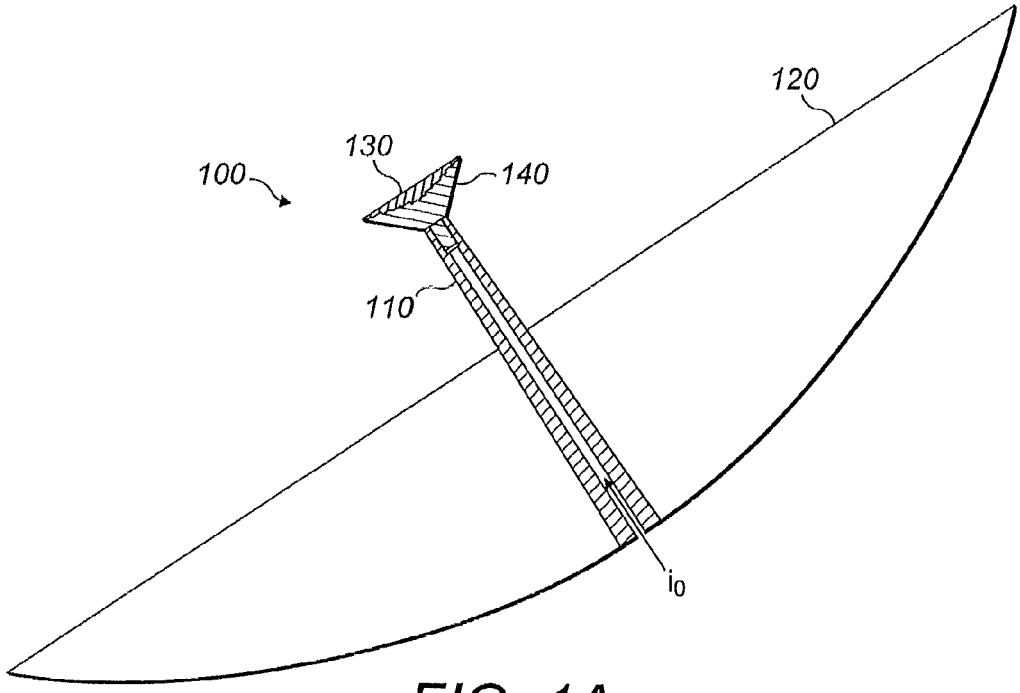
FIG. 1A (Prior Art)
FIGS. 1A and 1B illustrate a conventional reflector antenna.
Figure 1B:
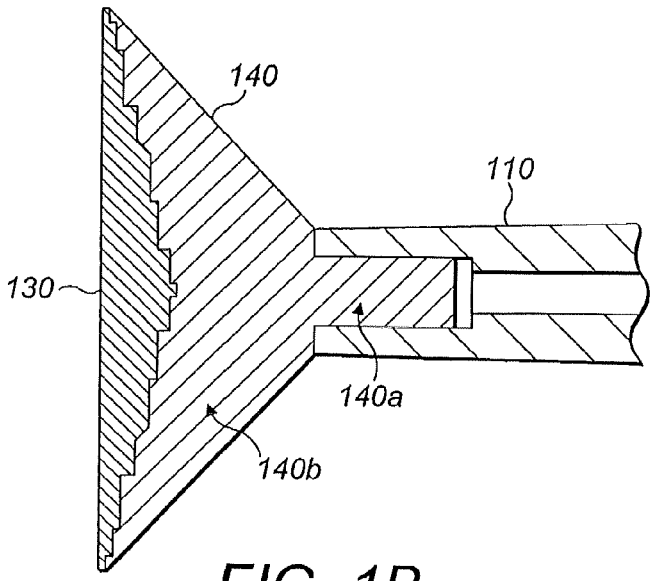
FIG. 1B (Prior Art)
Figure 2:
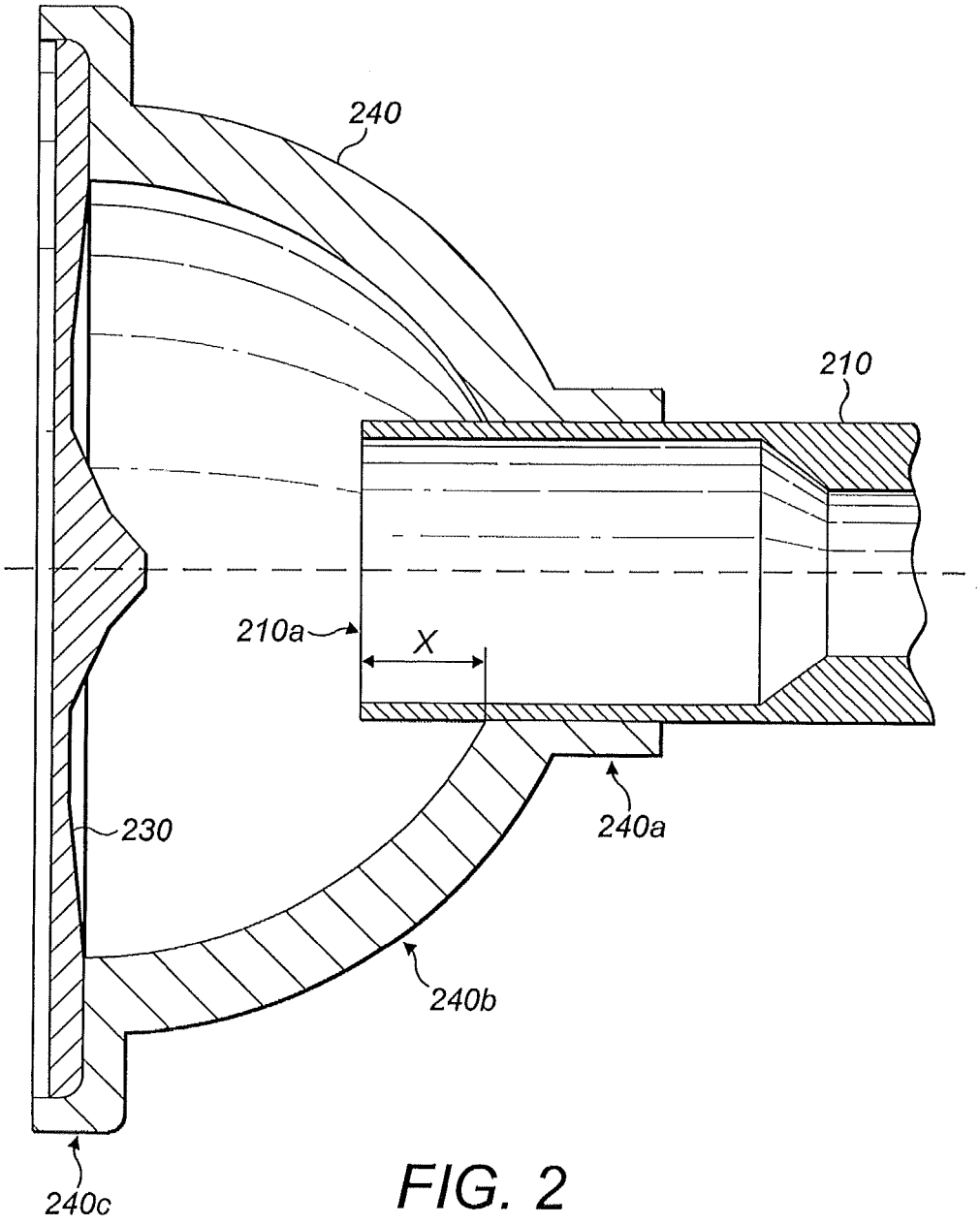
FIG. 2 illustrates a cross-section of a splashplate support for use in a reflector antenna, according to an embodiment of the present invention.

Referring now to FIG. 2, a splashplate assembly in a reflector antenna is illustrated in cross-section, according to an embodiment of the present invention. Here, the term 'splashplate assembly' refers to the waveguide feed 210, splashplate 230 and splashplate support 240. FIG. 2 and other ones of the accompanying drawings are not to scale, and are provided for illustrative purposes only. The reflector antenna comprises a waveguide feed 210, a splashplate 230, a splashplate support 240 and a primary reflector. The primary reflector is not shown in FIG. 2. The splashplate 230 is configured to direct a beam emitted from an aperture 210*a* of the waveguide feed 210 towards the primary reflector. Specifically, a beam emitted from the aperture 210*a* is reflected by the splashplate 230 towards the primary reflector, which in turn reflects the beam towards a destination. The primary reflector may be shaped to achieve a specified gain, cross-polar and sidelobe performance.

The waveguide feed 210 is configured to receive a dual-band input signal, i.e. a signal that includes a plurality of frequencies, wherein the frequencies are divided amongst two distinct transmission bands. The waveguide feed 210 and splashplate 230 are both formed of a material or materials that are electrically conductive at the frequencies for which the reflector antenna is designed. For example, the waveguide feed 210 and splashplate 230 can be formed of aluminium when the reflector antenna is designed for use at microwave frequencies. In the present embodiment, the waveguide feed is configured to receive an input signal including frequencies in the $K_a$ band. Specifically, the input signal includes frequencies in a lower band from 19.7 to 212 gigahertz (GHz), and frequencies in a higher band from 29.5 to 31.0 GHz. However, these frequency ranges are merely exemplary, and the present invention is not limited to use in the $K_a$ band. Other embodiments of the present invention may be configured for use at different frequencies.

Figure 5A:
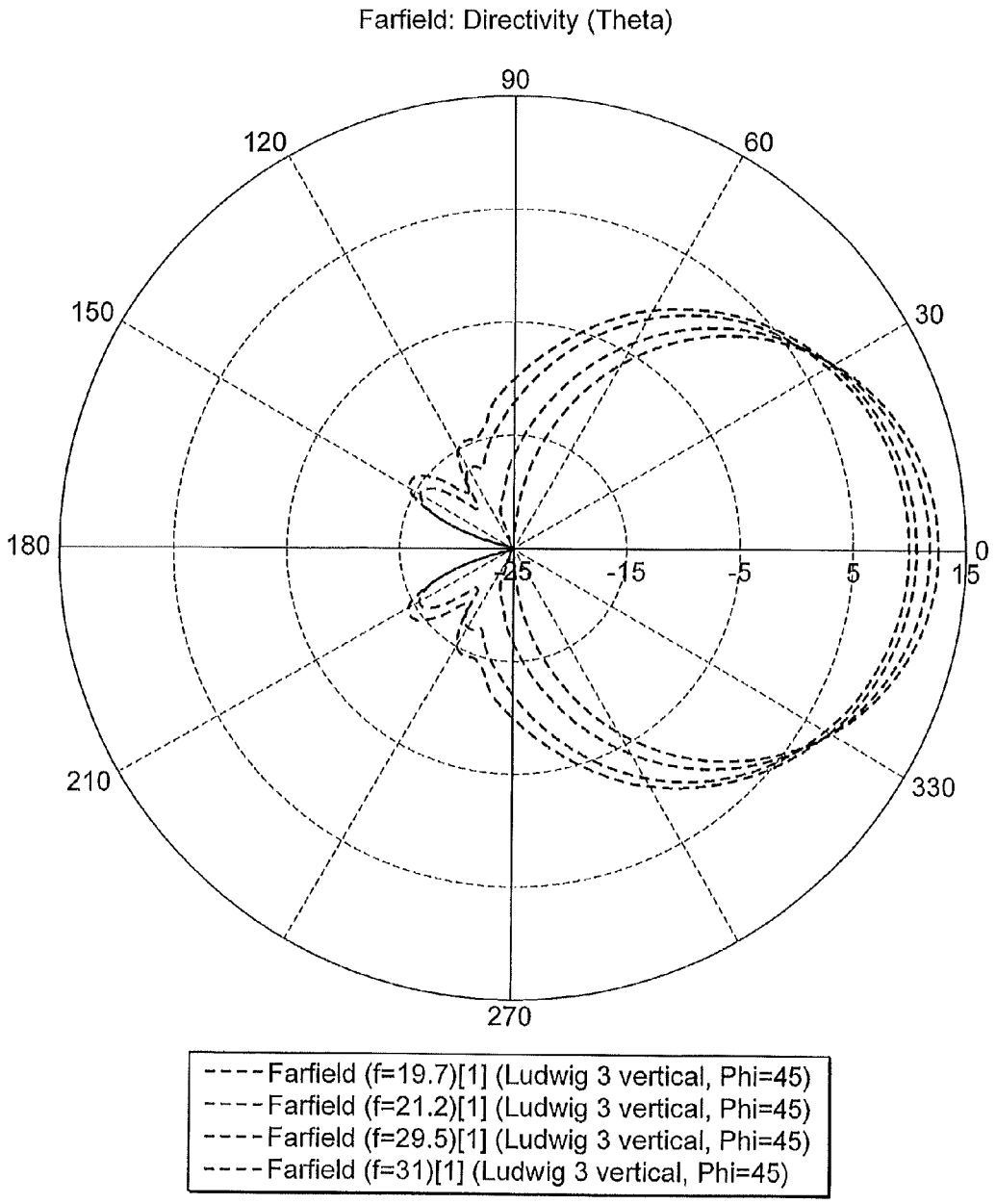
FIGS. 5A and 5B illustrate co-polar and cross-polar radiation patterns of the lower and upper frequency bands for the waveguide feed of FIG. 4.

The splashplate 230 can be configured to size, position and shape the beam emitted from the aperture 210*a* in order to produce a desired pattern for illumination of the reflector and to provide a good match (VSWR) in both bands. For example, the splashplate patterns can be ring focus in nature with the beam peak offset from the splashplate feed axis, which is illustrated as a dashed line in FIG. 2. This arrangement can enable sidelobes to be minimised in the reflected beam. Also, the waveguide feed 210 can be configured to produce similar feed patterns at the aperture in both the lower band and upper band as depicted in FIG. 5A. This can ensure that the splashplate patterns, i.e. the pattern of the beam after it is reflected from the splashplate 230, are similar for both the lower and upper bands, minimising a trade off between the bands in terms of reflector shaping and antenna performance.

In the present embodiment, the splashplate 230 is supported by a splashplate support 240 which comprises a first engaging portion 240*a*, a second engaging portion 240*c*, and a supporting portion 240*b* connecting the first and second engaging portions 240*a*, 240*c* such that the splashplate 230 can be supported in a predetermined position relative to the waveguide feed 210. In the present embodiment, the supporting portion 240*b* is formed as a continuous wall, and will hereinafter be referred to as a "supporting wall". The first engaging portion 240*a* is configured to engage with the outer surface of the waveguide feed 210, and the second engaging portion 240*c* is configured to engage with an outer edge of the splashplate 230. In the present embodiment, the support 240 is formed from polytetrafluoroethylene (PTFE), having a dielectric constant of about 2.1.

However, the present invention is not limited to this material, and in general any low-dielectric constant material may be used for the support 240. As the dielectric constant is increased, the wall thickness should be decreased accordingly, and design sensitivity will increase. In the present embodiment, where the splashplate assembly is configured for use at $K_a$ band frequencies, the relative permittivity $\in_r$ of the dielectric splashplate support 240 should be less than 4, and preferably less than 3. The present invention is not limited to this range of $\in_r$ for the splashplate support, and in other embodiments configured for use at different frequencies, other values of $\in_r$ may be appropriate. In some embodiments, a layered structure of different materials may be used to form the supporting wall 240*b*, in a similar manner to a radome (radar-dome) structure.

As shown in FIG. 2, the splashplate support 240 is hollow. That is, the supporting wall 240*b* is itself solid, but is shaped such that the support 240 and splashplate 230 define a space, or void, between the waveguide feed aperture 210*a* and the splashplate 230. In the present embodiment, as the supporting portion 240*b* is a continuous wall, the splashplate support 240 encloses the space.

The waveguide feed 210 extends through an opening in the supporting wall 240*b* and into the space. Because the support 240 is configured to engage with an outer surface of the waveguide feed 210, the hollow interior of the waveguide feed 210 can be kept free of dielectric. This maximises the bandwidth over which the waveguide feed 210 can be tuned to operate at two separate frequency bands simultaneously, and also enables the design process to be simplified by allowing items such as the waveguide feed to be optimised independently from the complete splashplate assembly. Furthermore, the hollow splashplate support has minimal impact on the radiation patterns, in contrast to conventional solid supports, and so the splashplate itself can initially be designed without having to consider the effect of the splashplate support. In contrast, a conventional splashplate support is restricted to use in a single frequency band due to the significant impact of the dielectric support, particularly inside the feed aperture. Also, the conventional splashplate assembly has to be designed as a complete assembly, necessitating a more complex and time-consuming design process.

Also, in the present embodiment the support 240 is configured such that when the first engaging portion 240*a* is engaged with the outer surface of the waveguide feed 210, the support 240 is spaced apart from the aperture 210*a*. Specifically, the first engaging portion 240*a* and supporting wall 240*b* are spaced apart from the aperture 210*a* by a distance X, in a direction away from the splashplate 230. Placing the support 240 external to the waveguide feed 210, and separating the support 240 from the aperture 210*a* in this way, prevents the dielectric body of the support 240 from interfering with the electromagnetic fields around the vicinity of the aperture 210*a*. Similarly, spacing the support 240 away from a central region of the splashplate 230 prevents the dielectric from interfering with fields around the electrically sensitive central region of the splashplate 230. The support 240 shown in FIG. 2 can therefore minimise losses and distortions in the splashplate patterns.

Although preferably the splashplate support 240 is configured to be spaced apart from the waveguide aperture 210*a*, as in the present embodiment, in other embodiments there may be no separation between the support and aperture once the splashplate support is engaged with the waveguide feed.

In the present embodiment the supporting wall 240*b* is configured to be substantially uniform in thickness. Preferably, the supporting wall 240*b* has a thickness of less than or equal to about $\lambda/2$, where $\lambda$ is a characteristic wavelength of the beam within the dielectric material of the supporting wall 240*b*. In particular, a preferred range of thicknesses can be 0.4 to 0.6 $\lambda$, although in some embodiments other thickness could be used if necessary. Since a dual-band signal is input to the waveguide feed 210, there will be a range of wavelengths present in the beam. The characteristic wavelength could, for example, be a wavelength corresponding to a centre frequency of a transmission band of the beam emitted from the waveguide feed aperture, or could be an average wavelength of the beam, such as a mean wavelength of the plurality of wavelengths included in the beam. In the present embodiment, the characteristic wavelength is taken as a wavelength substantially midway between the upper and lower bands, i.e. a wavelength corresponding to a frequency between 25-26 GHz. Increasing the supporting wall 240*b* thickness will tune the splashplate support 240 towards the lower frequency band, at the expense of the upper frequency band.

Figure 3A:
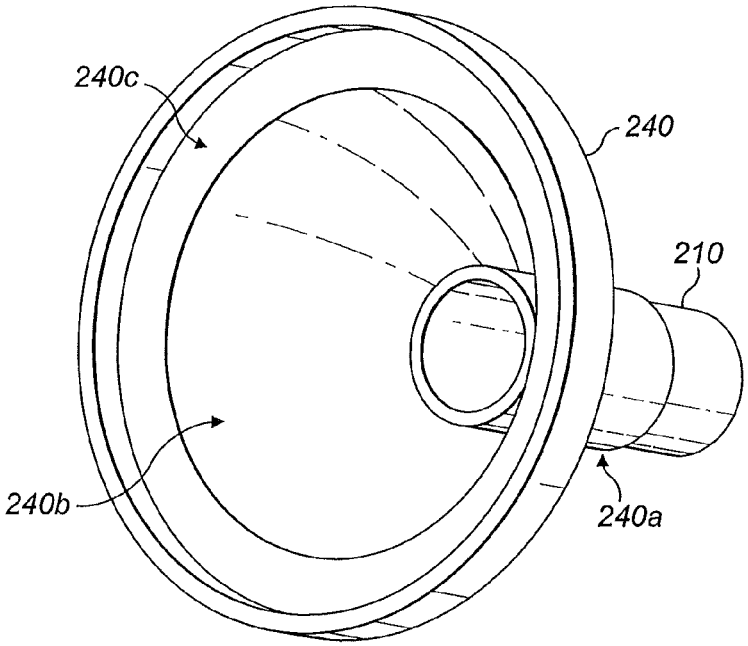
FIGS. 3A to 3C illustrate the splashplate support of FIG. 2, in perspective view.
Figure 3B:
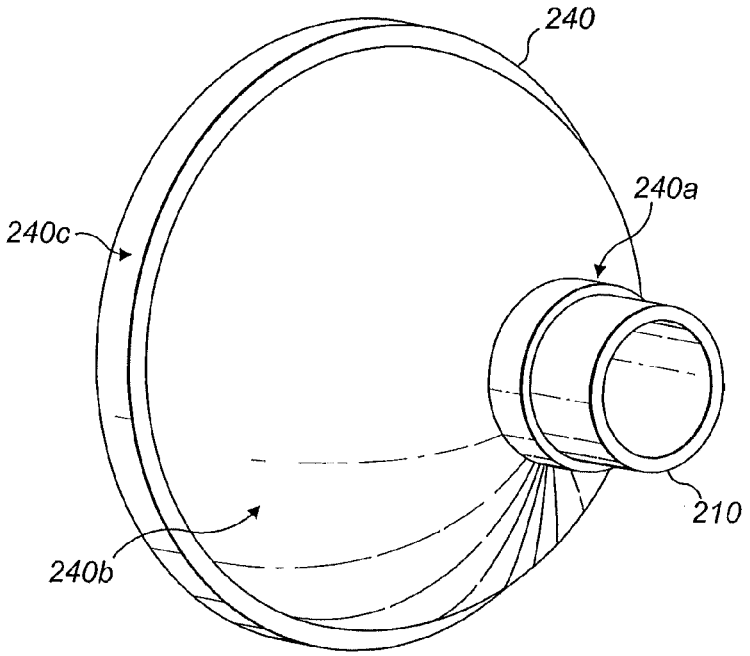
Figure 3C:
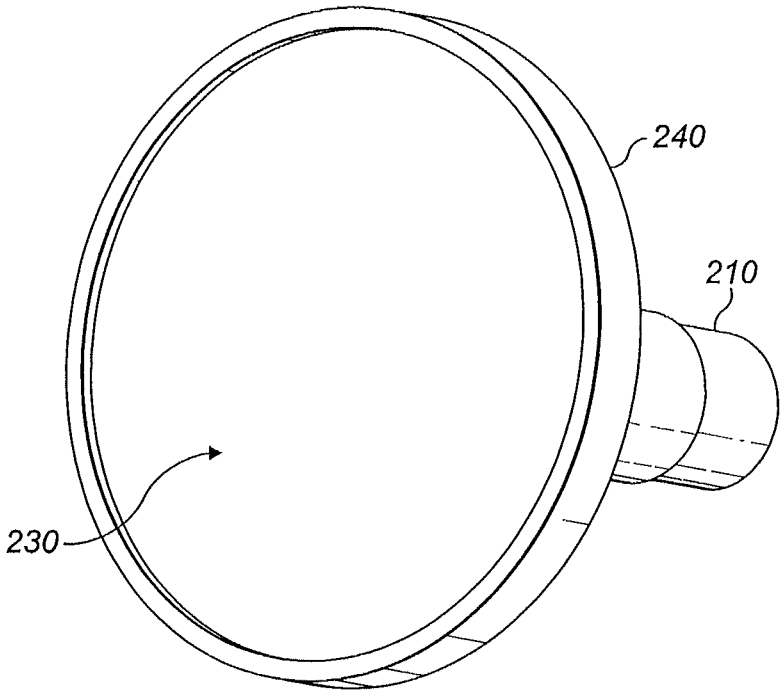

The splashplate support 240 is illustrated in further detail in FIGS. 3A, 3B and 3C, which are front and rear perspective views of the splashplate support 240. As shown in FIG. 3A, the second engaging portion 240*c* is configured to receive and engage with the splashplate, which is omitted in FIG. 3A for clarity. Also, as shown in FIG. 3B, in the present embodiment the first engaging portion 240*a* is formed as a collar that is configured to be secured around the waveguide feed 210. FIG. 3C illustrates the splashplate support 240 with the splashplate 230 installed. Various methods may be used for securing the first engaging portion 240*a* to the waveguide feed 210, and for securing the second engaging portion 240*c* to the splashplate 230. For example, the first and second engaging portions 240*a*, 240*c* may be secured using an interference fit, snap fit, screw fit, adhesive, or mechanical fastenings such as screws. The first engaging portion 210*a* may be configured to be adjustable, such that the separation distance X between the support 240 and the aperture 210*a* (cf. FIG. 2) can be varied once the support, waveguide feed and splashplate have been assembled together.

The first and second engaging portions 240*a*, 240*c* are not limited to the forms shown in FIGS. 2, 3A, 3B and 3C, and in other embodiments the first and second engaging portions may be shaped differently. Also, although in the present embodiment the first and second engaging portions 240*a*, 240*c* and support wall 240*b* are integrally formed as a single body, in other embodiments they may be formed separately and then subsequently joined to form the support 240.

Preferably, the supporting wall is shaped to approximately correspond to the phase front of the radiated field from the splashplate. This allows the influence of the dielectric support on the patterns to be minimised, and hence enables the reflector antenna to be operated at wider transmission bands. In particular, the supporting wall position and thickness may be determined based on the return loss and crosspolar performance in both bands, and the supporting wall can be curved or profiled to suit. Although in the present embodiment the supporting wall 240*b* is formed to be substantially hemispherical and is based on an elliptical profile, the present invention is not limited to this particular design. For example, in another embodiment the supporting wall may be planar or geodesic. The supporting wall may be configured to minimise reflections and interference with the path of the beam through the supporting wall.

Figure 4:
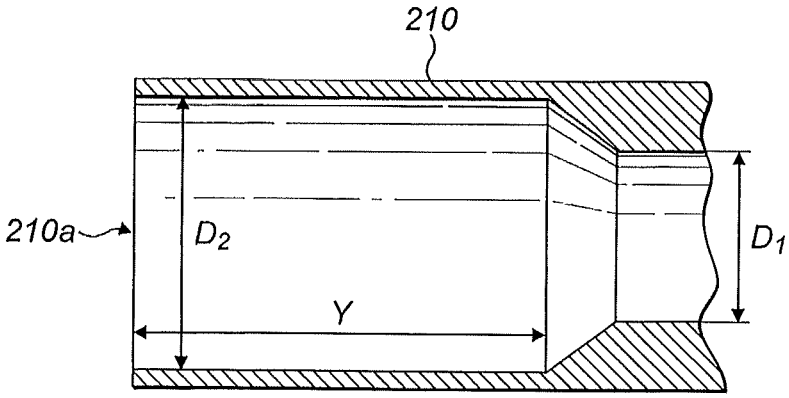
FIG. 4 illustrates the waveguide feed of FIG. 2, in cross-section.

Referring now to FIG. 4, the dual-band waveguide feed of FIG. 2 is illustrated in cross-section. As described above with reference to FIG. 2, the dual-band waveguide feed 210 is configured to receive a dual-band input signal, i.e. a signal including a plurality of frequencies distributed amongst a first transmission band and a second transmission band. Specifically, the dual-band waveguide feed 210 is configured to receive the input signal in a first transmission mode, which in the present embodiment is a $TE_{11}$ mode. As shown in FIG. 4, the dual-band waveguide feed 210 includes means 210*b* for converting a transmission mode of the upper frequency band from a first transmission mode to a mixed transmission mode, the mixed transmission mode including the first transmission mode and a second transmission mode. In the present embodiment, the second transmission mode is a $TM_{11}$ mode. The means for converting the first transmission mode to the mixed transmission mode can be referred to as a "mode launcher" or "mode converter". The mode launcher 210*b* is configured such that it does not significantly affect frequencies of the lower transmission band. Therefore at the aperture 210*a*, frequencies in the upper frequency band are propagated in the mixed transmission mode, i.e. $TE_{11}$+$TM_{11}$, and frequencies in the lower frequency band are propagated in the first transmission mode only, i.e. $TE_{11}$.

In more detail, in the present embodiment the mode launcher 210*b* comprises a tapered region inside the waveguide feed 210, in which the internal diameter of the waveguide feed 210 is increased from a first diameter $D_1$ to a second diameter $D_2$. The second diameter $D_2$, which is greater than the first diameter $D_1$, is the diameter of the waveguide aperture 210*a*. In the present embodiment, the diameter $D_2$ of the waveguide aperture 210*a* is approximately equal to the free space wavelength of signals in the lower frequency band. This ensures that at the aperture 210*a*, the $TE_{11}$ mode E & H plane patterns in the lower band are similar, and the resultant cross-polar is low.

The operation of the mode launcher 210*b* on frequencies in the upper frequency band will now be described. The relatively abrupt change in the diameter of the waveguide feed 210 at the mode launcher 210*b* results in the generation of a $TM_{11}$ mode, which propagates in the upper band only. Specifically, the relative diameters $D_1$ and $D_2$ are chosen to ensure that the cut-off frequency for the $TM_{11}$ mode falls between the upper and lower frequency bands. The size of the mode launcher 210*b* and the distance Y from the aperture 210*a* can be varied to control the electric fields at the waveguide aperture 210*a*, and can be selected to give an optimum mixed mode $TE_{11}$+$TM_{11}$ feed behaviour with uniform aperture fields and low edge field curvature, in a similar manner to a conventional dual-mode feed horn or Potter horn. In more detail, as shown in FIG. 4 the mode launcher 201*b* is spaced apart from the waveguide aperture 210*a* by a predetermined distance Y, which ensures that both the $TE_{11}$ and $TM_{11}$ modes in the upper band are substantially in phase at the aperture 210*a*. Specifically, a phase difference between the $TE_{11}$ mode and the $TM_{11}$ mode will vary according to the distance from the mode launcher 210*b*. The distance Y can therefore be selected such that the phase difference at the aperture 210*a* is close to zero, i.e. such that the $TE_{11}$ and $TM_{11}$ modes in the upper band are substantially in-phase at the aperture 210*a*.

Therefore by controlling the size and position of the mode launcher 210*b*, i.e. the internal diameters $D_1$ and $D_2$ and the separation Y from the waveguide aperture 210*a*, uniform field patterns can be achieved in both planes and the cross-polar component can be reduced. The lower band patterns can remain unaffected by the mode launcher 210*b*, although the return loss should still be considered for both bands when designing the mode launcher 210*b*. Although in the present embodiment the mode launcher 210*b* is formed as a tapered section of the waveguide feed 210, the present invention is not limited to this geometry. For instance, in other embodiments the mode launcher 210*b* may be formed as one or more steps in the internal diameter, or using some other profiled geometry such as a ridged geometry.

The features described above can ensure that the waveguide feed 210 has optimum and similar pattern performance in both the lower and the upper bands.

Although in the present embodiment, $TM_{11}$ and $TE_{11}$ modes are used, the present invention is not limited to this case. Other embodiments may be configured for use with other modes, for example the aperture size could be increased by about 40% to utilise the $TE_{12}$ mode. In some embodiments, a corrugated waveguide feed may be used.

Figure 5B:
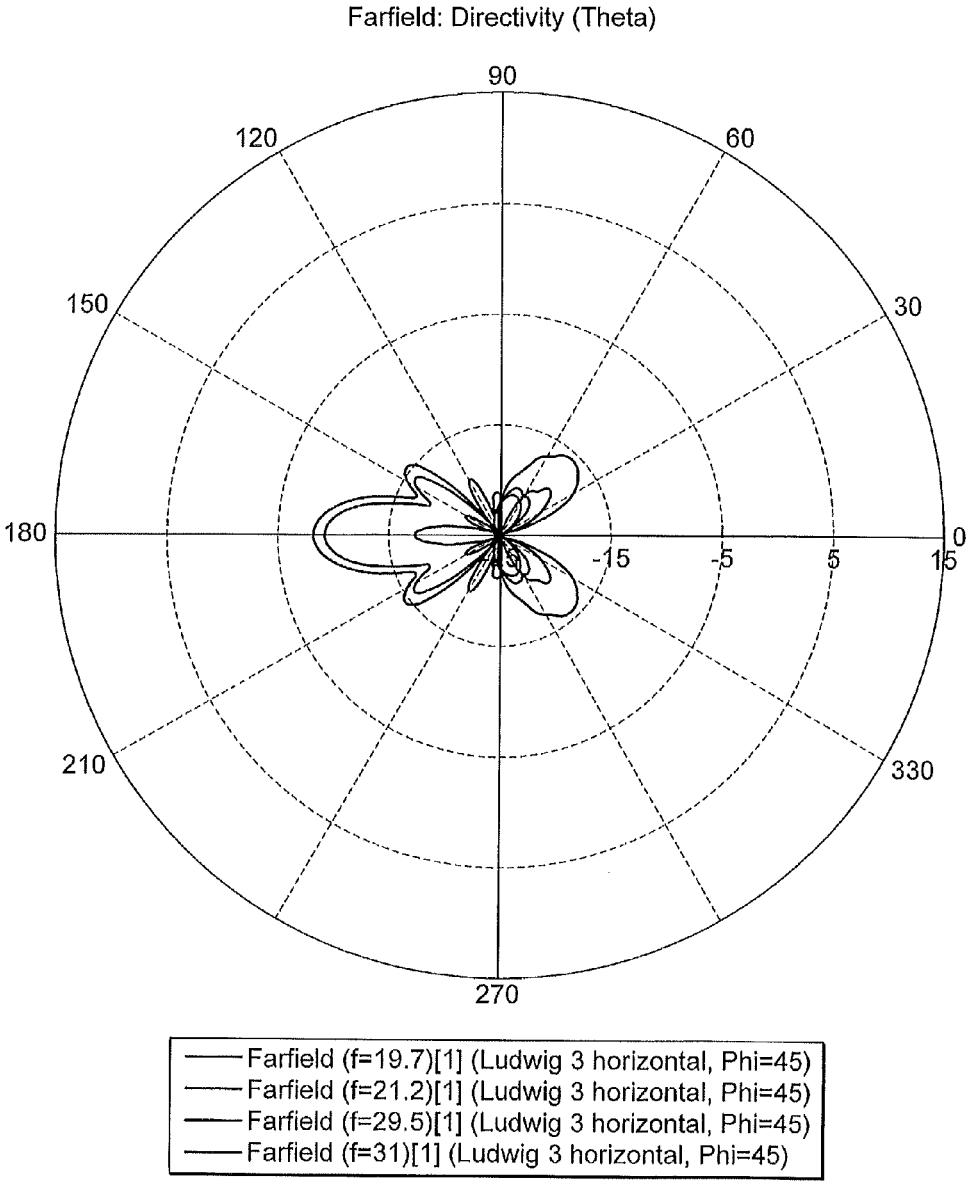
Figure 6A:
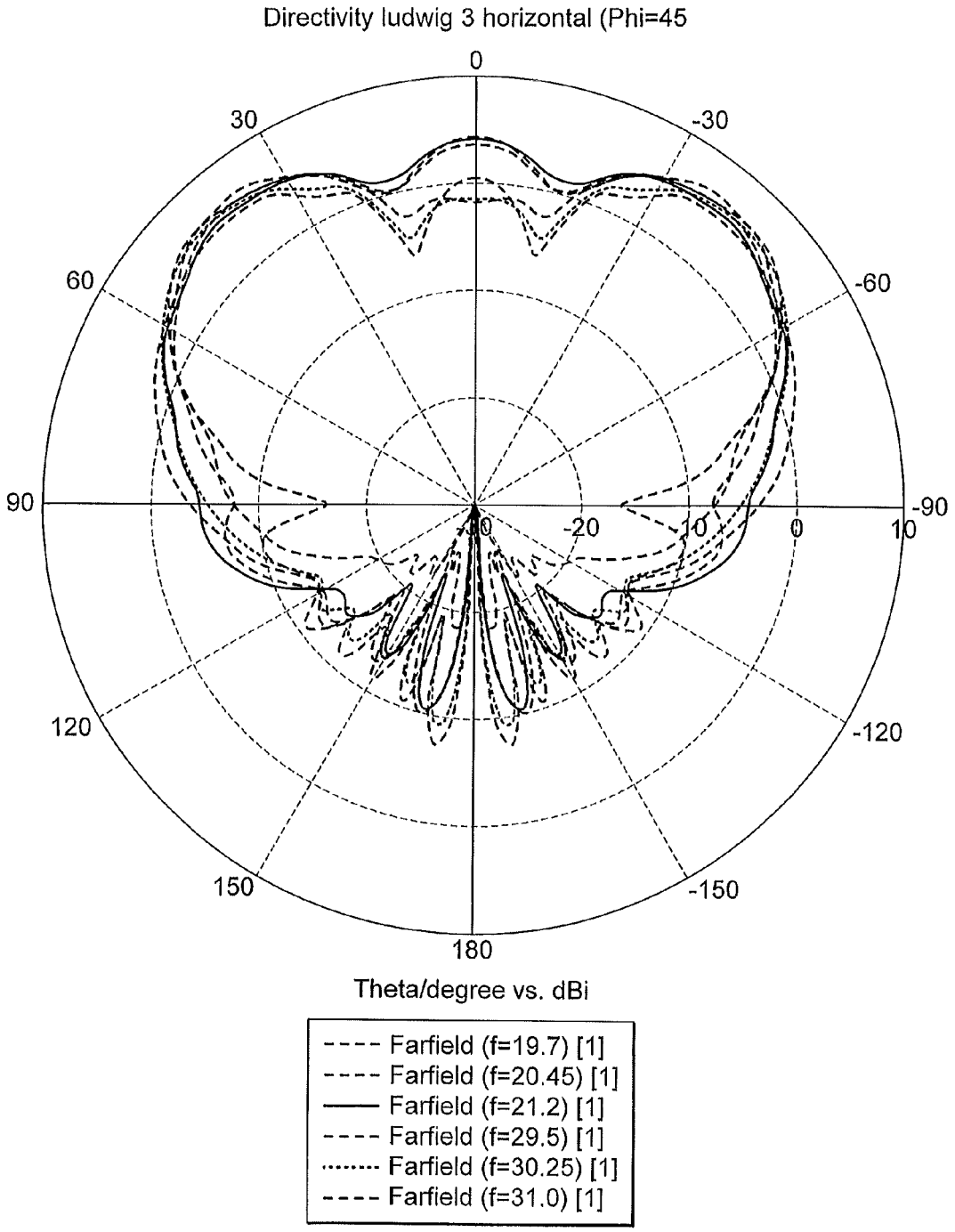
FIGS. 6A and 6B illustrate co-polar and cross-polar radiation patterns of the lower and upper frequency bands for the splashplate assembly of FIG. 2.
Figure 6B:
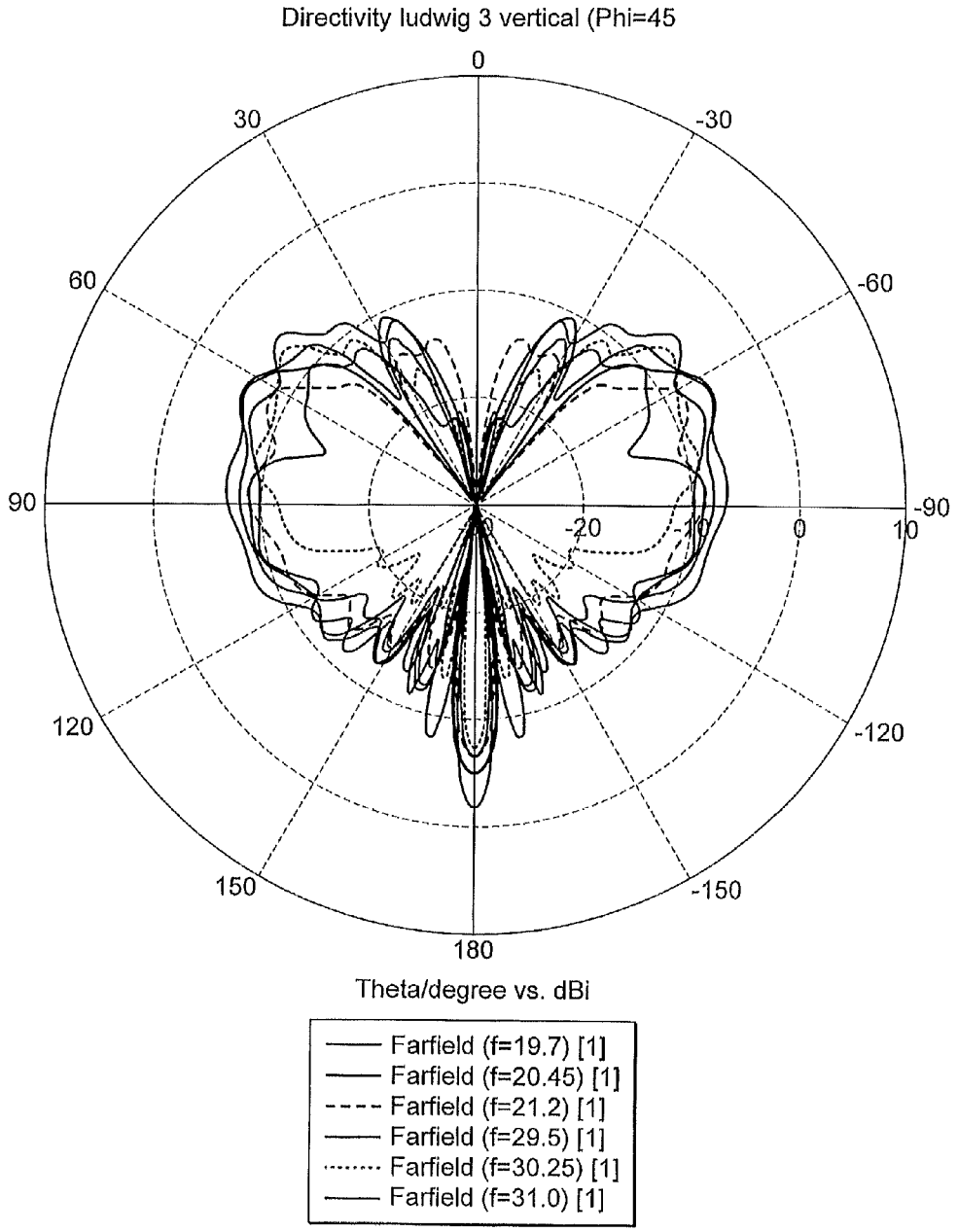

FIG. 5A illustrates the co-polar radiation patterns for the lower and upper bands in the waveguide feed of FIG. 4, and FIG. 5B illustrates the cross-polar radiation patterns for the lower and upper bands in the waveguide feed of FIG. 4. Similarly, FIG. 6A illustrates the co-polar radiation patterns for the lower and upper bands in the splashplate assembly of FIG. 2, and FIG. 6B illustrates the cross-polar radiation patterns for the lower and upper bands in the splashplate assembly of FIG. 2. In FIGS. 5A, 5B, 6A and 6B, an angle of 0 degrees corresponds to the boresight direction, i.e. the direction in which the beam is emitted from the aperture and in which the transmitted beam is directed. As shown in FIGS. 5A, 5B, 6A and 6B, both upper and lower bands exhibit similar co- and cross-polar components in the forward direction. The waveguide feed patterns of FIGS. 5A and 5B are of primary interest out to about 60°, corresponding to the angle subtended by the splashplate, and have beam peaks on boresight at 0°. The splashplate assembly patterns of FIGS. 6A and 6B are of primary interest out to about 80° and have co-polar peaks that are nominally off-axis in a direction between 30° and 60°.

Figure 7:
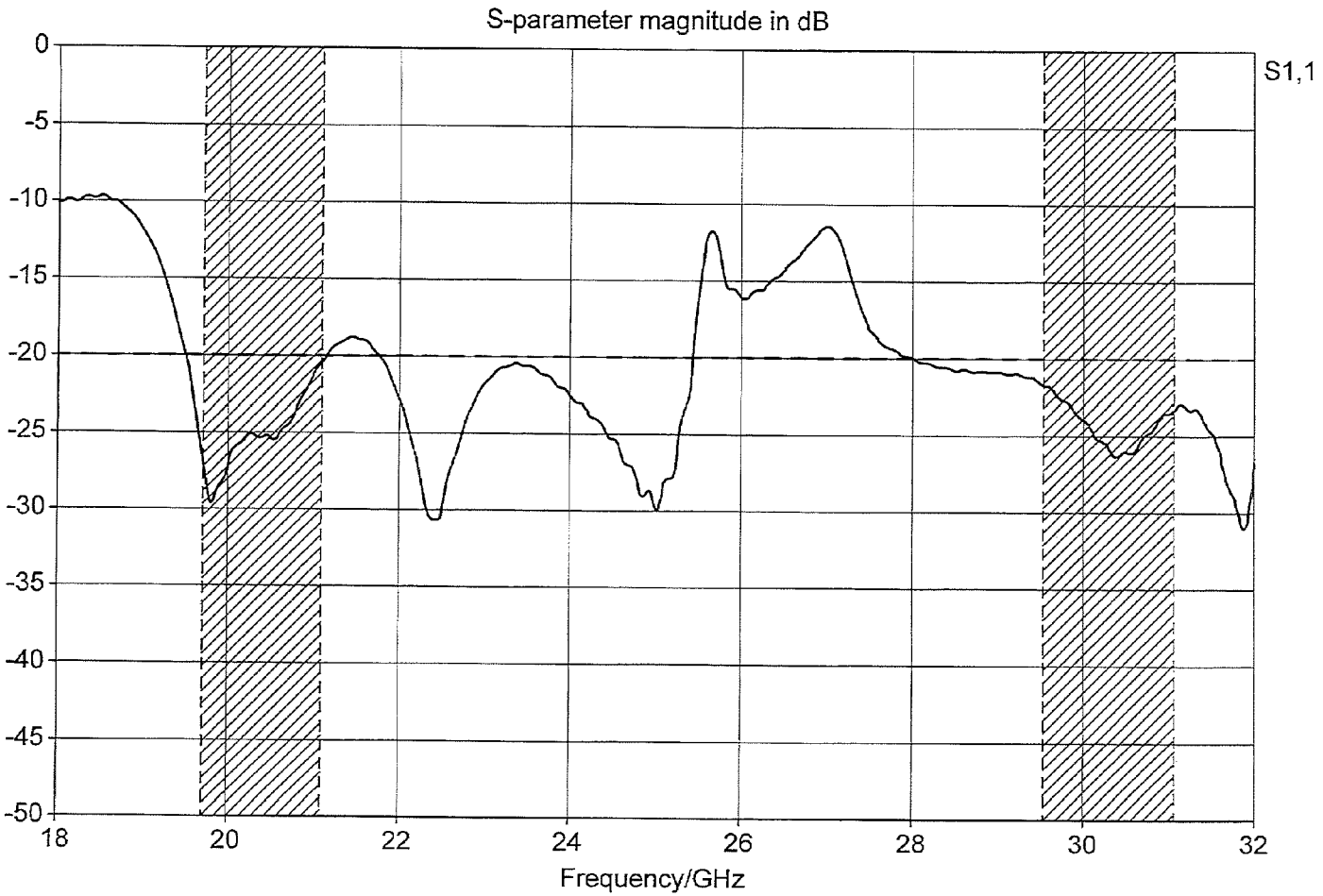
FIG. 7 is a graph of return loss against frequency covering the lower and upper frequency bands for the splashplate assembly of FIG. 2.

Referring now to FIG. 7, a graph of return loss against frequency is illustrated for the dual-band splashplate assembly of FIG. 2. Typically, a maximum acceptable return loss at frequencies for which the antenna will be used is about 20 decibels (dB), although the acceptable limit may vary according to the application. For instance, in some cases a return loss of 15 dB may be acceptable. In FIG. 7, design frequencies in the lower and upper bands are shaded for clarity. As shown in FIG. 7, in both the lower and upper bands the return loss is below the acceptable limit of 20 dB. Furthermore, the acceptable regions having return loss below 20 dB extend well beyond the required frequency bands, hence the splashplate assembly of the present embodiment would also be suitable for use with wider frequency bands. Between the upper and lower bands there are return loss peaks around 26 and 27 GHz. These peaks arise due to the mode launcher, and can be moved to a higher or lower frequency by varying the dimensions of the mode launcher and the waveguide feed. Therefore in an embodiment of the present invention that is intended for use at frequencies around 26 GHz, the mode launcher can be adjusted accordingly to ensure that the return loss peak does not fall within a desired transmission band, by changing the dimensions D1 and D2 of FIG. 4 accordingly.

Figure 8A:
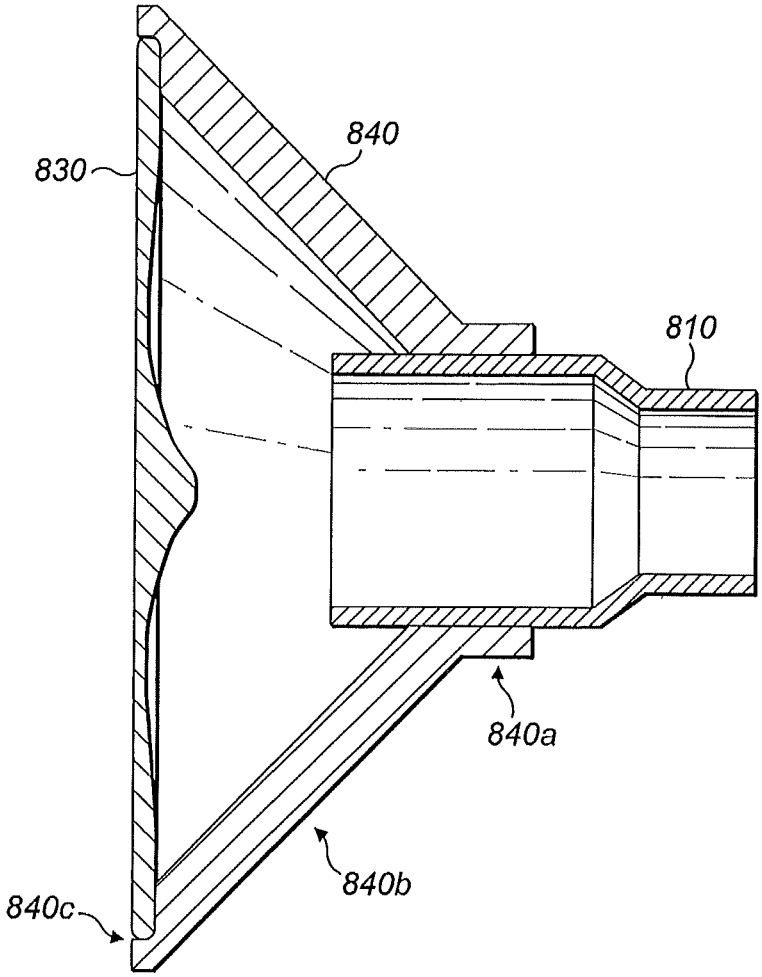
FIGS. 8A to 8C illustrate a splashplate support for use in a reflector antenna, according to a further embodiment of the present invention.
Figure 8B:
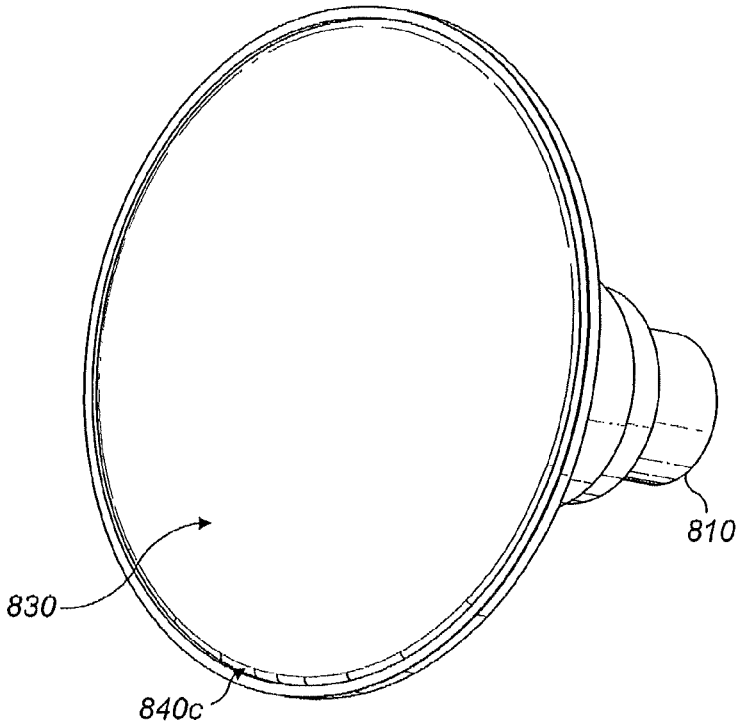
Figure 8C:
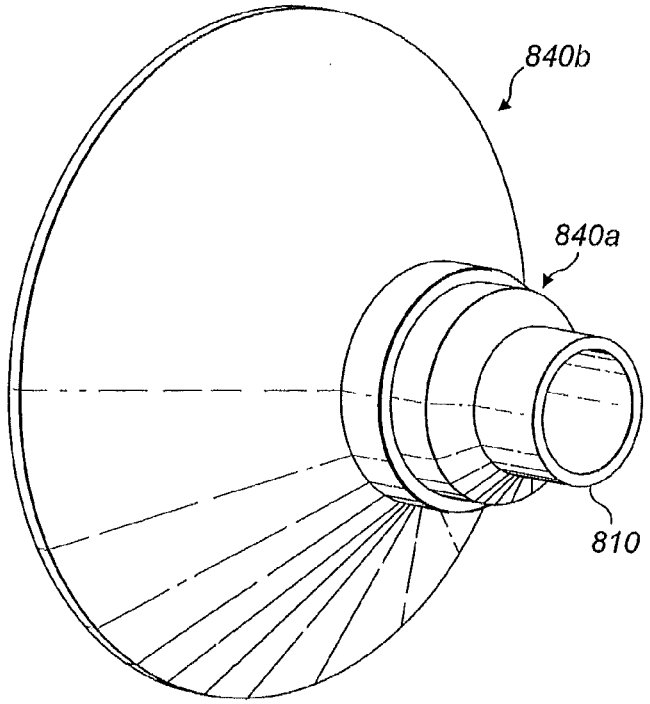

An alternative embodiment of the splashplate support is illustrated in FIGS. 8A to 8C. In this embodiment, a splashplate assembly for a reflector antenna includes a waveguide feed 810 and splashplate 830, similar to the waveguide feed and splashplate of FIG. 2. Also, the splashplate support 840 of the present embodiment is similar to that of FIG. 2 in that it comprises a first engaging portion 840*a* for engaging with an outer surface of the waveguide feed 810, a second engaging portion 840*c* for engaging with the splashplate 830, and a supporting wall 840*b* extending between the two engaging portions 840*a*, 840*c*. However, unlike the embodiment of FIG. 2, in the present embodiment the supporting wall 840*b* is linear when viewed in cross-section, instead of curved. Accordingly, the splashplate support 840 of the present embodiment is conical, when viewed in three dimensions. In this embodiment and other embodiments, the wall thickness may be varied along the profile of the supporting wall 840*b* to optimise the performance.

Figure 9:
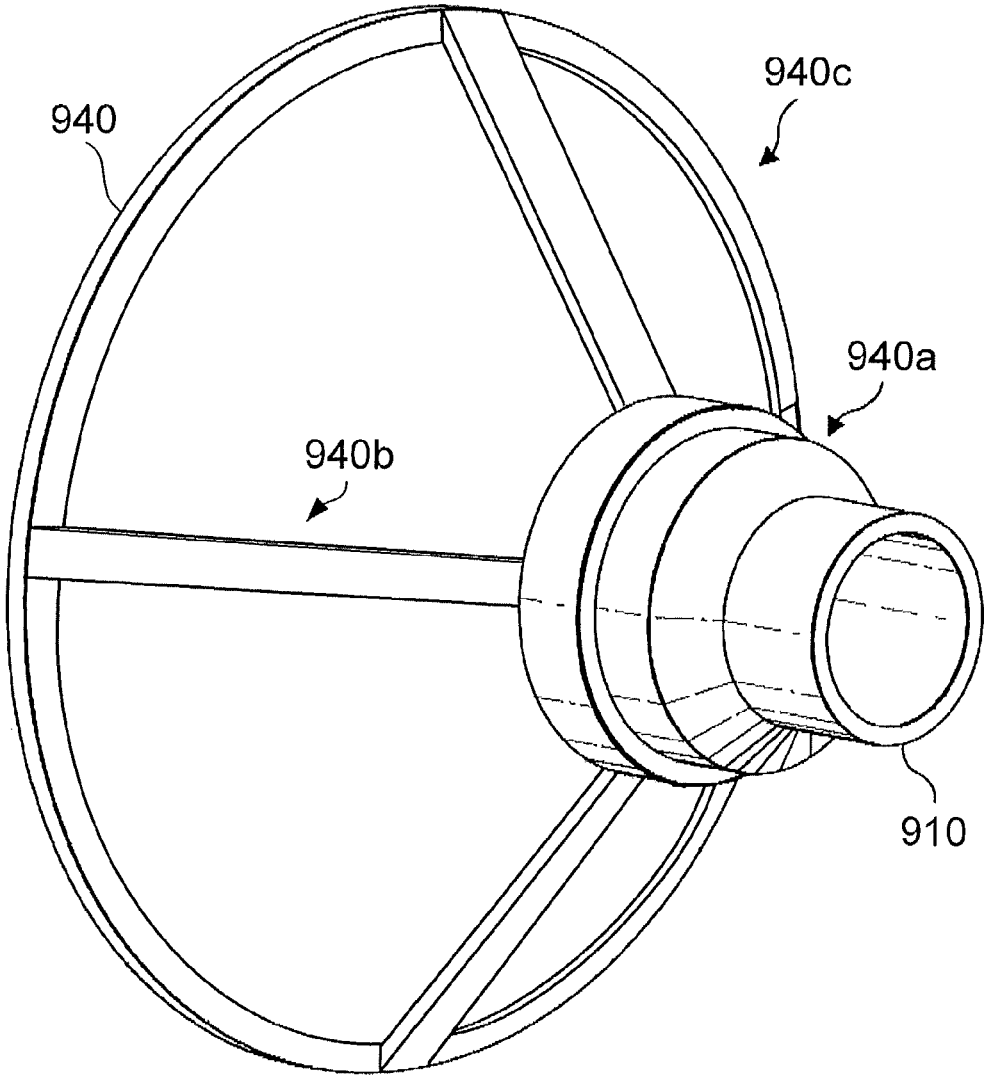
FIG. 9 illustrates a splashplate support comprising a plurality of supporting struts, according to yet a further embodiment of the present invention.

Although embodiments of the present invention have been described which comprise a continuous wall that connects the engaging portions and encloses a void, i.e. a space that is free of dielectric material, in other embodiments other types of supporting portion may be used. For example, instead of a wall, the first and second engaging portions may be joined by a supporting portion such as one or more dielectric struts, with open space between the struts. That is, in some embodiments the supporting portion may not be formed as a wall, and may not be continuous. FIG. 9 illustrates a splashplate support 940 according to an embodiment of the present invention, in which the supporting portion 940*b* comprises a plurality of struts connecting the first and second engaging portions 940*a*, 940*c*. As with the supporting wall in the embodiments of FIGS. 2, 3A to 3C and 8A to 8C, the struts 940*b* of the present embodiment are arranged to define a space between the aperture and the splashplate.

Embodiments of the present invention have been described which can allow dual-band operation with splashplate-type reflector antennas, as a splashplate support is arranged to define a space between the waveguide feed aperture and the splashplate. Since the space defined by the support includes the path taken by a beam of electromagnetic radiation from the aperture to the splashplate, the beam's path is not obstructed by the support. Therefore frequencies in both the upper and lower bands are unaffected by the presence of the support. In contrast, dual-band operation has not been possible with conventional splashplate supports and waveguide feeds. Embodiments of the present invention may be used in both circular polarisation and linear polarisation applications.

Furthermore, although embodiments of the present invention have been described in which the waveguide feed is circular in cross-section, the invention is not limited to this arrangement. Other cross-sections with some radial symmetry can be used, for instance in some embodiments the waveguide feed horn can have a square cross-section and the splashplate support can similarly have a square cross-section.

Additionally, embodiments of the present invention have been described in which the waveguide feed includes a mode launcher that has a larger internal diameter nearer the aperture than at the input to the waveguide feed. This ensures that the diameter at the aperture is electrically larger, i.e. corresponds to a greater number of wavelengths, than at the input. However, in some embodiments the internal diameter may not be physically larger near the aperture. For example, the waveguide feed can be made electrically larger at the aperture by inserting a dielectric plug or ring without physically increasing the internal diameter, since the wavelength will be reduced in the dielectric. Hence the mode launcher does not have to be embodied as a change in physical dimensions. This approach would have a detrimental effect on performance, but could nevertheless find use in certain applications, for example where size constraints prevent a larger physical diameter from being used at the aperture.

Also, although embodiments of the present invention have been described in which the splashplate support engages with an outside surface of the waveguide feed, the invention is not limited to this arrangement. In some embodiments, the first engaging portion can be otherwise formed, for example as a thin collar to be inserted into the waveguide aperture. Such an arrangement would degrade the performance to some extent, but may be required in embodiments where space constraints prevent the support from engaging with the outer surface of the waveguide feed.

Whilst certain embodiments of the present invention have been described above, the skilled person will recognise that many variations and modifications are possible, without departing from the scope of the invention as defined in the accompanying claims.

The invention claimed is:

1. A reflector antenna comprising:

a dual-band waveguide feed configured to receive an input signal in a first transmission mode, where the input signal can include a plurality of frequencies arranged into upper and lower frequency bands, and the waveguide feed including a mode converter configured for converting a transmission mode of an upper frequency band from the first transmission mode to a mixed transmission mode including the first transmission mode and a second transmission mode;

a reflector;

a splashplate configured to direct a beam emitted from an aperture of the waveguide feed to the reflector; and a splashplate support having a first engaging portion for engaging with the waveguide feed, a second engaging portion for engaging with the splashplate, and a supporting portion connecting the first engaging portion to the second engaging portion and arranged to define a space between the waveguide feed aperture and the splashplate, wherein the supporting portion has a thickness equal to substantially $\lambda/2$, where $\lambda$ is a characteristic wavelength of a beam inside the supporting portion.

2. The reflector antenna of claim 1, wherein the supporting portion will be spaced apart from the aperture of the waveguide feed in a direction away from the splashplate, when the first engaging portion is engaged with the waveguide feed.

3. The reflector antenna of claim 1, wherein the characteristic wavelength is a wavelength corresponding to a centre frequency of a transmission band of a beam when emitted from the aperture of the waveguide feed, or is an average wavelength of the beam, or is a value between the average wavelength and the wavelength corresponding to the centre frequency.

4. The reflector antenna of claim 1, wherein the supporting portion has a shape corresponding to a wavefront of a beam when emitted from the waveguide feed after it has been reflected from the splashplate.

5. The reflector antenna of claim 1, wherein the supporting portion is curved or elliptical in cross-section.

6. The reflector antenna of claim 1, wherein the supporting portion is a substantially continuous wall.

7. The reflector antenna of claim 1, wherein the first engaging portion is configured to engage with an outer surface of the waveguide feed.

8. The reflector antenna of claim 1, wherein the splashplate support is formed of polytetrafluoroethylene PTFE.

9. The reflector antenna of claim 1, wherein the mode converter is spaced apart from the aperture by a predetermined distance, such that for the upper band both the first and second transmission modes are substantially in phase at the aperture.

10. The reflector antenna of claim 1, wherein the mode converter comprises:

a taper, one or more steps, or a profiled change in an internal diameter of the waveguide feed, and connects a section of a first diameter $D_1$ to a section of a second diameter $D_2$, wherein the second diameter is greater than the first diameter.

11. The reflector antenna of claim 1, wherein the first transmission mode is a $TE_{11}$ mode and the second transmission mode is a $TM_{11}$ mode.

12. The reflector antenna of claim 1, wherein the waveguide feed is circular in cross-section, and wherein a diameter of the aperture is substantially one wavelength of a frequency in the lower frequency band.

13. The reflector antenna of claim 1, wherein the waveguide feed is configured for use at Ka band frequencies.

14. A satellite comprising:

a satelite body; and the reflector antenna of claim 1.

* * * * *